US007645007B2

(12) United States Patent
Komatsu

(10) Patent No.: US 7,645,007 B2
(45) Date of Patent: Jan. 12, 2010

(54) INK JET RECORDING APPARATUS, NOZZLE INSPECTION METHOD AND PROGRAM THEREOF

(75) Inventor: Shinya Komatsu, Nagano-ken (JP)

(73) Assignee: Seiko Epson Corporation, Tokyo (JP)

( * ) Notice: Subject to any disclaimer, the term of this patent is extended or adjusted under 35 U.S.C. 154(b) by 201 days.

(21) Appl. No.: 11/540,610

(22) Filed: Oct. 2, 2006

(65) Prior Publication Data

US 2007/0076029 A1 Apr. 5, 2007

(30) Foreign Application Priority Data

Sep. 30, 2005 (JP) ..... 2005-288639
Feb. 8, 2006 (JP) ..... 2006-031367

(51) Int. Cl.
*B41J 29/38* (2006.01)

(52) U.S. Cl. ..... 347/9; 347/5; 347/14

(58) Field of Classification Search ..... 347/5, 347/9, 11, 14, 19, 23, 67
See application file for complete search history.

(56) References Cited

U.S. PATENT DOCUMENTS 4,590,482 A * 5/1986 Hay et al. ..... 347/19
6,070,959 A * 6/2000 Kanbayashi et al. ..... 347/11

FOREIGN PATENT DOCUMENTS

JP 59-178256 A 10/1984

* cited by examiner

*Primary Examiner*—Lam S Nguyen
(74) *Attorney, Agent, or Firm*—Sughrue Mion, PLLC

(57) ABSTRACT

In this ink jet printer, on the basis of voltage of a nozzle plate 27 at the time that a print head 24 is driven and in a state in which a predetermined potential difference has been generated between the nozzle plate 27 and the inspection area 52, a nozzle inspection is performed so as to confirm whether or not ink is in practice being ejected from each nozzle 23, so that ink can be sequentially ejected to an inspection area 52 from each nozzle. According to the nozzle inspection voltage change is detected in the nozzle plate 27 by a voltage detection circuit 54 provided on an encoder board 64 on a carriage 22. Since both the nozzle plate 27 and the voltage detection circuit 54 are installed on the carriage 22, and the distance between the two of them is shorter, they are less likely be affected by noise. In addition, there is no need to prepare a new board on which the voltage detection circuit 54 needs to be mounted.

11 Claims, 10 Drawing Sheets

INK JET RECORDING APPARATUS, NOZZLE INSPECTION METHOD AND PROGRAM THEREOF

BACKGROUND OF THE INVENTION

1. Field of the Invention

The present invention relates to an ink jet recording apparatus, a nozzle inspection method and a program thereof.

2. Description of the Related Art

Conventionally, as discussed in Patent Document 1, for instance, an ink jet recording apparatus is known that, by not only grounding to the ground a capping member for capping a nozzle area of a print head at the time that printing has been stopped, but also by applying voltage to the print head, generates a potential difference between the print head and an inspection area provided within the capping member, causes an electric field detection unit provided on the capping member to detect any change in field intensity between the print head and the inspection area when ink droplets charged on the print head in that condition fly out, thereby confirming whether or not any ink droplets have actually flown out. As this type of inspection is believed to employ induced current, it is referred to herein as "a nozzle inspection employing induced current". [Patent Document 1] Japanese Patent Application Laid Open No. SHO59-178256

However, since the electric field detection unit is provided on the capping member, as the number of nozzle inspections increases, ink accumulates on the electric field detection unit, or on the periphery thereof, and a detection signal leaks by way of the ink that has accumulated. This may result in preventing the detection characteristics desired from being obtained.

SUMMARY OF THE INVENTION

The present invention has been made to solve such the problem and aims to provide an ink jet recording apparatus that can obtain the detection characteristics desired when a nozzle is inspected, and a nozzle inspection method.

The present invention has adopted the following modules to achieve the above object.

A nozzle inspection method of an ink jet recording apparatus that performs printing on a print medium by using a print head having a plurality of nozzles comprises a nozzle inspection step of sequentially generating pressure on a print recording liquid in individual nozzles with a predetermined potential difference generated between a print recording liquid receiving area that can receive print receiving liquid ejected from each nozzle and print recording liquid in the print head, and on the basis of electrical change at the print head carrying out a nozzle inspection so as to confirm whether or not the print recording liquid can be ejected from each nozzle.

In the nozzle inspection method, on the basis of electrical change at a print head a nozzle inspection is performed, by sequentially generating pressure on a print recording liquid in individual nozzles, with a predetermined potential difference generated between a print recording liquid receiving area and the print recording liquid contained in the print head, so as to determine whether or not print recording liquid can be ejected from each individual nozzle. In this context, while the print recording liquid tends to accumulate easily in the print recording liquid receiving area, in contrast, it does not accumulate easily at the print head. Thus, in a case where electric change at the print head is detected, as is done in the present invention, a leak of a detection signal of a kind caused by deposits of the ink recording liquid is not likely to occur.

Accordingly, the detection characteristics desired can be obtained when the nozzle is inspected.

In the nozzle inspection method of the invention, a nozzle inspection step may consist of a nozzle inspection that is based on electrical change in the print recording liquid in the print head, and that is conducted by sequentially generating pressure on the print recording liquid in individual nozzles with a predetermined potential difference generated between the print recording liquid contained in the print head and the print recording liquid receiving area, so as to determine whether print recording liquid can be ejected from each nozzle.

In the nozzle inspection method of the invention, the nozzle inspection step may also detect electrical change in a nozzle plate of the print head when electrical change in the print recording liquid in the print head has been detected. This would be advantageous in detecting electrical change because in terms of distance the nozzle plate is a part of the print head that is closer to the print recording liquid receiving unit.

In the nozzle inspection method of the invention, the nozzle inspection step may detect occurrences of electrical change at the print head depend on whether print recording liquid from each nozzle lands on the print recording liquid receiving area. Experience indicates that a major electrical change occurs when the print recording liquid lands on the print recording liquid receiving area.

An ink jet recording apparatus that adopts the nozzle inspection method of this invention may be of a type that performs printing while moving the print head in the direction almost orthogonal to a transport direction of a print medium, or, alternatively, may be a so-called line printer that has a print head that is formed long enough in size so as to fill a printing area in a width direction of a print medium and that is fixed to the main body of the apparatus, and that performs printing only while it is transporting the print medium.

In the nozzle inspection method of the present invention, a detection device for detecting electrical change in a print recording liquid in the print head may also be provided on a board position either on the print head or on a carriage that moves the print head. As this could reduce a distance between the print recording liquid in the print head and the device for detecting electrical change, a detection signal becomes less susceptible to noise. In this context, the print head or the carriage (including a cartridge containing print recording liquid) generally has a board. For instance, a head driving board for ejecting print recording liquid from nozzles is known as a board on the print head, a board on which a position-determining circuit is formed to determine a position of the carriage is known as a board on the carriage, and a board on which a memory circuit is formed for storing residual amounts of print recording liquid is known as a cartridge board. Thus, a device for detecting electrical change may also be provided on existing types of boards such as those that have just been described.

In addition to the nozzle inspection step, the nozzle inspection method of the present invention may also include a vibration generation step that generates minute pressure until the print recording liquid in nozzles is vibrated but not ejected for nozzles that are not expected to eject print recording liquid during printing and recording. The nozzle inspection step may also prohibit the minute pressure generation step from being performed. Because the print recording liquid in nozzles can easily harden and thus cause clogging, the nozzles not included among the nozzles out of which print recording liquid is ejected during printing and recording should preferably prevent the print recording liquid in the nozzles from easily hardening by vibrating the print recording liquid. However, as this invention detects electrical change in the print recording liquid in a print head during a nozzle inspection, vibration of the print recording liquid in the nozzles causes noise and leads to a deterioration in the accuracy of detection. Thus, during a nozzle inspection, it is preferable to prohibit the print recording liquid in the nozzle from vibrating and thus prevent a deterioration in the accuracy of detection of electrical change.

In the nozzle inspection method of the present invention, the detection device for detecting electrical change in the print recording liquid in the print head may also include at least a circuit for amplifying electrical change in the print recording liquid in the print head. In this way, the possible effects of noise can be reduced even if noise is generated at a time when a post-amplification signal is transmitted by the electrical change detection module to a relatively remote location, in comparison with possible effects of noise generated when a pre-amplification signal is transmitted to the same location.

In the nozzle inspection method of the present invention, at a time of generating a predetermined potential difference between the print recording liquid in the print head and the print recording liquid receiving area, the nozzle inspection step may also ground the print recording liquid receiving area to the ground and apply voltage to the print recording liquid in the print head. Whereas, when the print recording liquid in the print head is grounded to the ground, and voltage is applied to the print recording liquid receiving area, there is a risk of electric current leaking due to deposits of print recording liquid accumulated in the print recording liquid receiving area, and of a predetermined potential difference not being generated between the print recording liquid in the print head and the print recording liquid receiving area, no such risk exists when the print recording liquid receiving area is grounded to the ground and voltage is applied to the print recording liquid in the print head, the latter arrangements are thus preferable.

In the nozzle inspection method of the present invention, the device for generating the predetermined potential difference may be a circuit for increasing voltage of electric wiring of a low voltage level that is laid inside the recording apparatus, and for then applying voltage to the print recording liquid in the print head, and such a device may be provided on the print head or the carriage. In this way it is possible to maintain the voltage of the electric wiring inside the apparatus at a low level. At such a time, the device for generating the predetermined potential difference may, together with the detection device for detecting electrical change in the print recording liquid in the print head, be provided on the board on the print head, or on the board on the carriage for moving the print head. In such away it is possible to eliminate the need for preparing separately a board for carrying a potential difference generation module.

In the ink jet recording apparatus that adopts the nozzle inspection method of the present invention, the print head has a nozzle-forming member that forms a plurality of nozzles, and the electrical change detection module may detect electrical change in the nozzle-forming member. As the nozzle-forming member contacts the print recording liquid in the print head, it is possible to detect electrical change in the print recording liquid in the print head by means of the nozzle-forming member.

Electronics into which an ink jet recording apparatus that adopts the nozzle inspection method of the invention can be incorporated includes electronic equipment (a compound machine) that, as well as incorporating an ink jet recording apparatus as a single unit, can also incorporate a combination of a scanner and a facsimile machine. In addition, print media include, for instance, various types of print sheets or resin films, boards made of glass or resin used in making a color filter or printed circuit boards, etc.

The ink jet recording apparatus for performing printing on a print medium by using a print head having a plurality of nozzles, comprises a driving module that drives the print head so that pressure is generated on a print recording liquid in the print head, a print recording liquid receiving area that is placed to receive the print recording liquid ejected from each nozzle, a potential difference generation module that generates a predetermined potential difference between the print recording liquid in the print head and the print recording liquid receiving area, an electrical change detection module that detects electrical change at the print head, and an inspection execution module that controls the driving module so that, in a condition in which the potential difference generation module has generated the predetermined potential difference between the print recording liquid in the print head and the print recording liquid receiving area, pressure is sequentially generated on the print recording liquid in individual nozzles, and so that, on the basis of electrical change at the print head a nozzle inspection is performed so as to confirm whether or not the print recording liquid can be ejected from each nozzle.

This ink jet recording apparatus controls a drive module so that, with a predetermined potential difference generated between the print recording liquid in the print head and the print recording liquid receiving area, pressure is sequentially generated on the print recording liquid in each nozzle, and on the basis of electrical change at the print head, a nozzle inspection is performed so as to determine whether or not print recording liquid is being ejected from each nozzle. In this context, while the print recording liquid tends to accumulate in the print recording liquid receiving area, it does not accumulate easily at the print head. Thus, in a case where electric change at the print head is detected, as occurs in the present invention, leaking of a detection signal caused by deposits of ink recording liquid is not likely to occur. Accordingly, the detection characteristics desired can be obtained when the nozzle is inspected. Alternatively, the ink jet recording apparatus may adopt any module that implements the various steps of the nozzle inspection method as described above.

The present invention may be a program for causing one or more computers to implement the respective steps of the nozzle inspection method as described above. The program may be recorded in a computer readable storage medium (such as a hard disk, a ROM, a FD, a CD, a DVD), may be delivered from one computer to another via a transmission medium (a communication network such as Internet or LAN), or may be given and received in any other form. Whether one computer is caused to execute the program, or more than one computer are assigned to execute the various steps, similar effects to the method described above can be achieved as long as the respective steps of the nozzle inspection method are executed.

BRIED DESCRIPTION OF THE DRAWINGS

DESCRIPTION OF THE PREFERRED EMBODIMENTS

Figure 1:
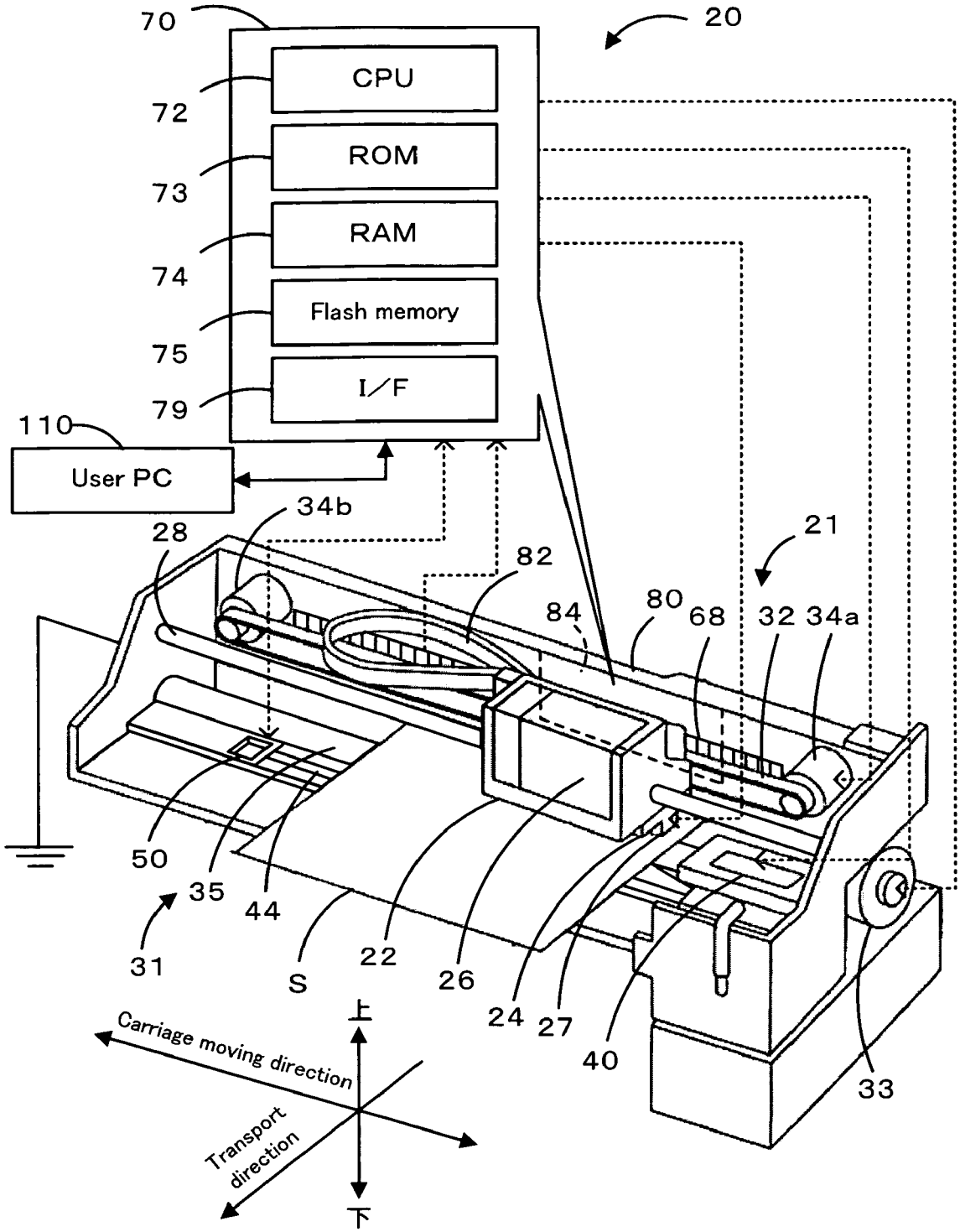
FIG. 1 is a block diagram schematically illustrating a configuration of an ink jet printer of this embodiment.
Figure 2:
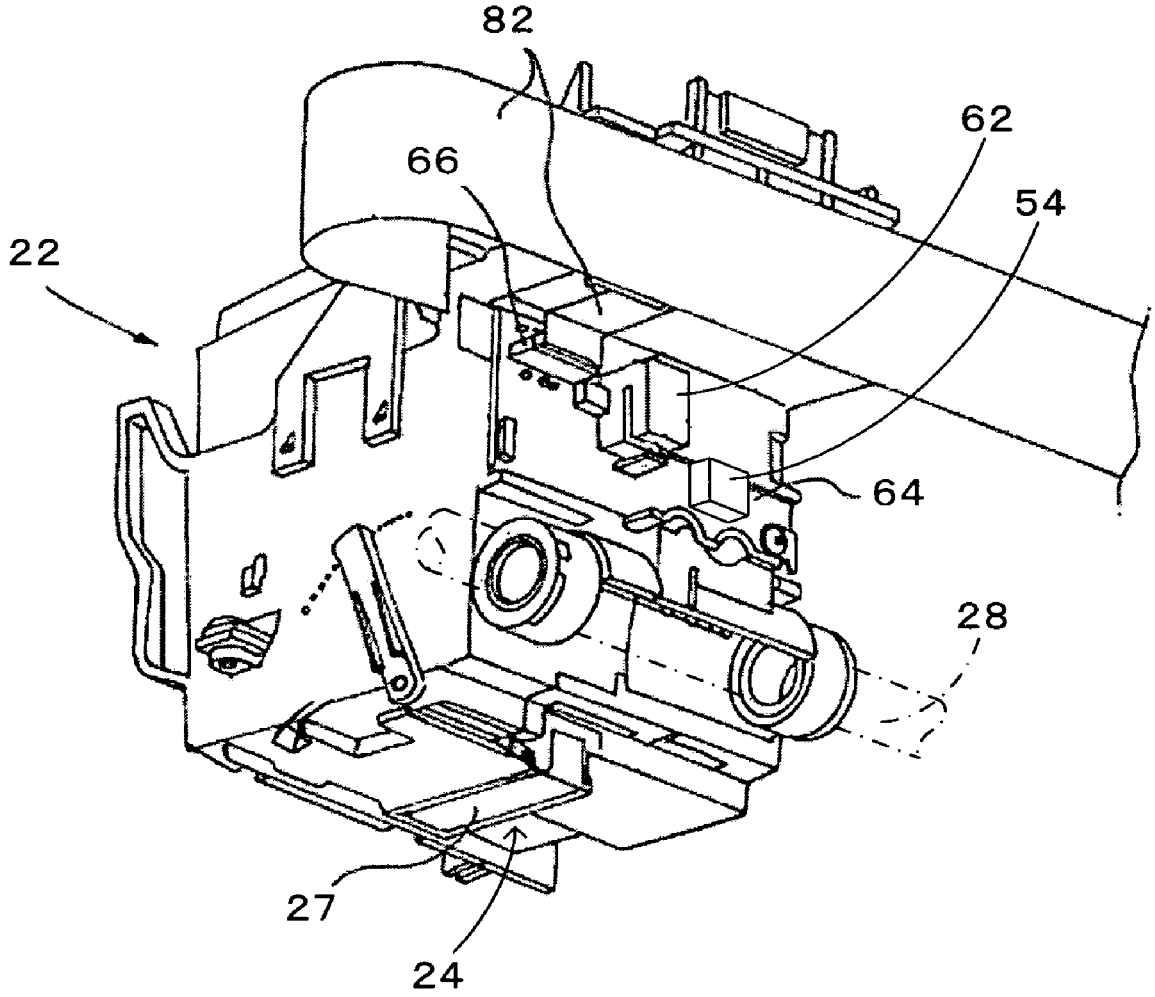
FIG. 2 is a perspective view when a carriage is viewed from the lower side of a rear face.
Figure 3:
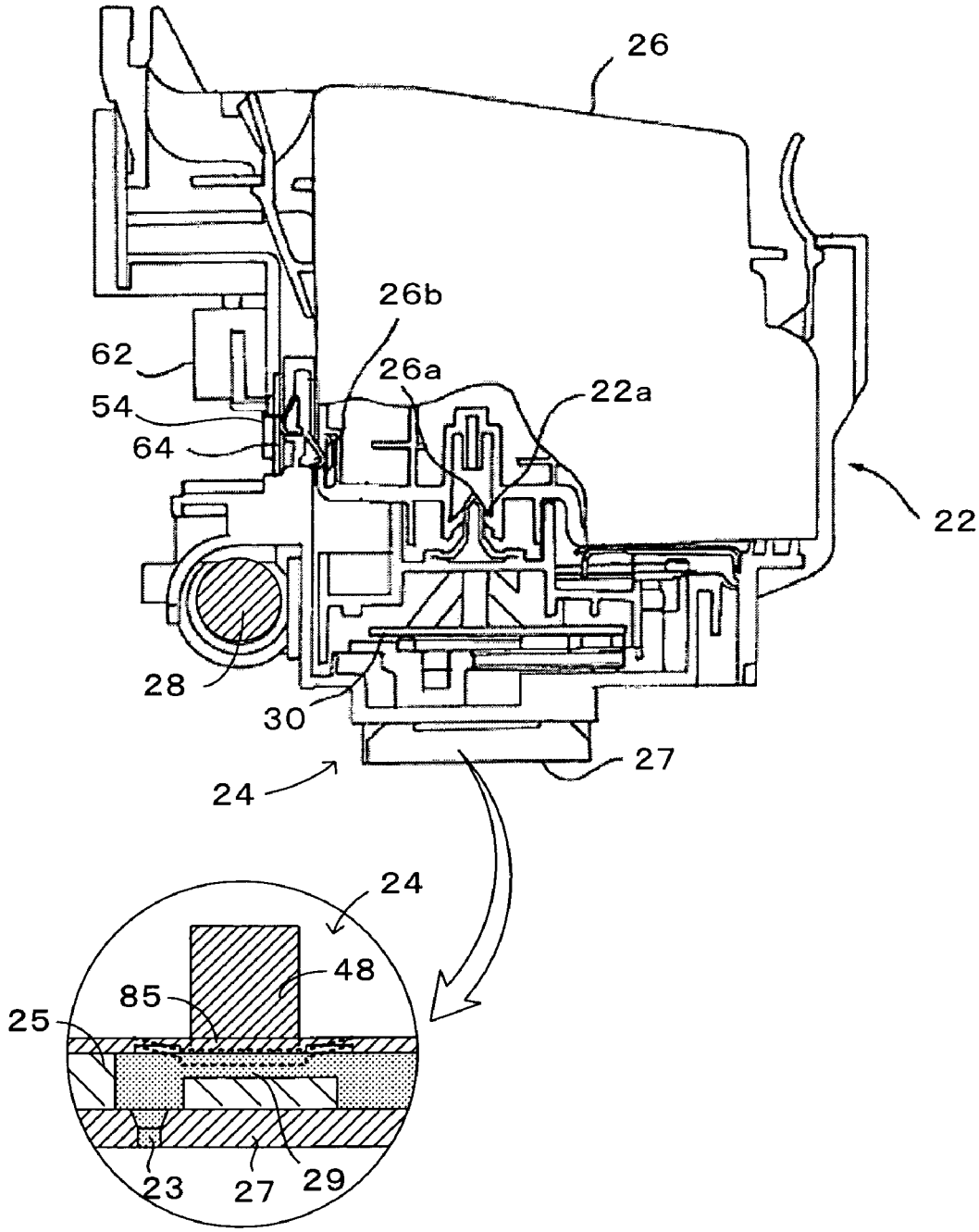
FIG. 3 is a left side elevation of the carriage (this is a broken-out section view, and a partially enlarged illustration is shown inside the circle).
Figure 4:
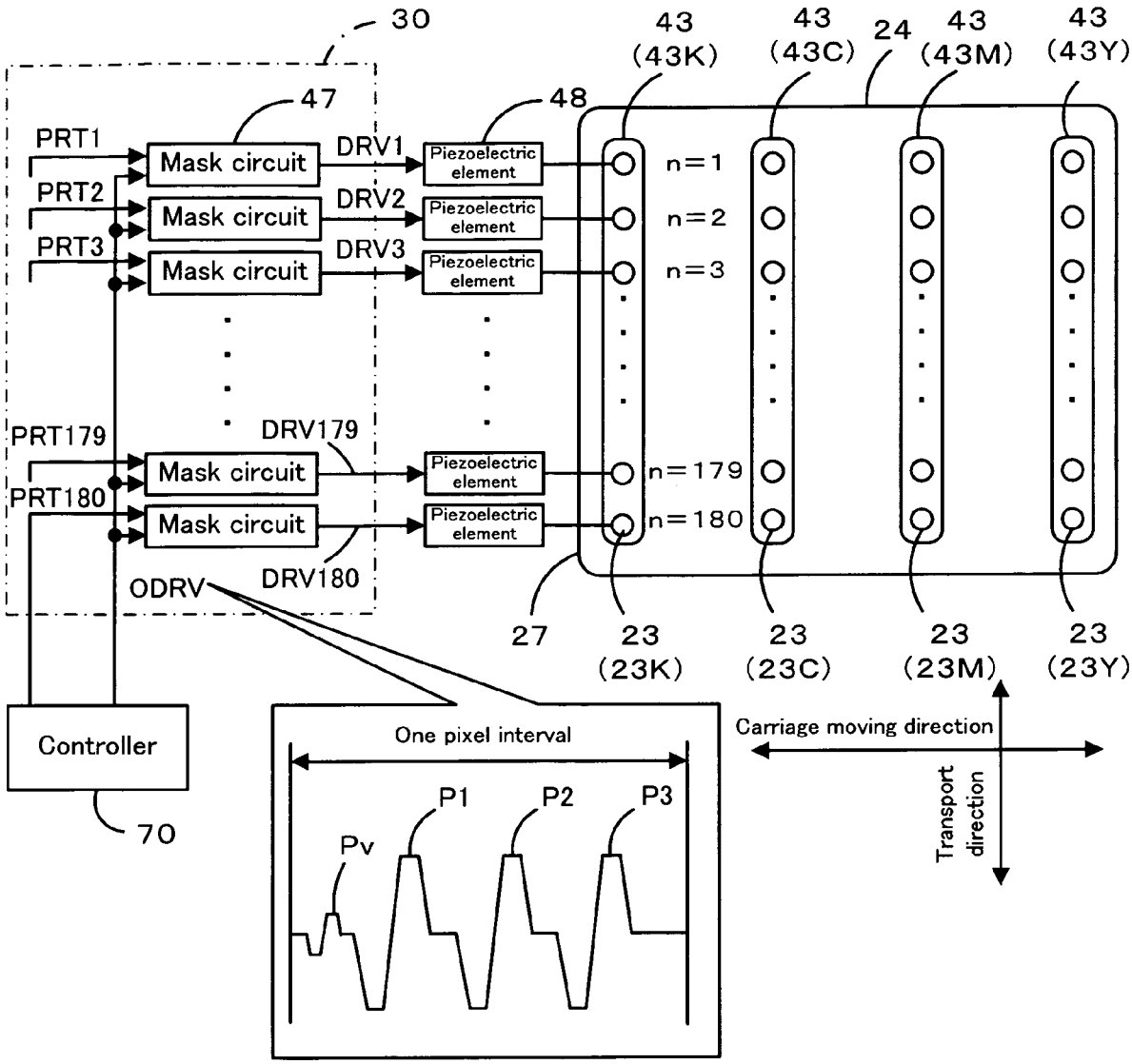
FIG. 4 is an illustration of an electric wiring connection of a print head.
Figure 5:
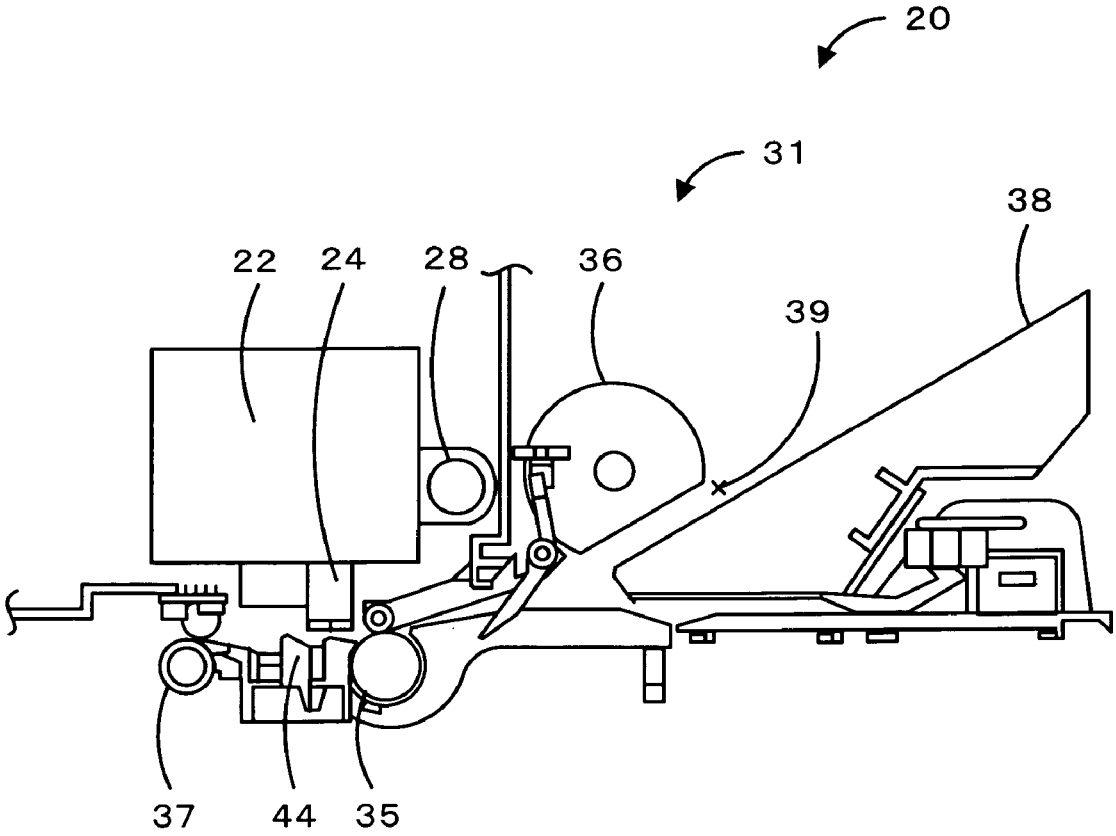
FIG. 5 is an illustration of a paper handling mechanism.
Figure 6:
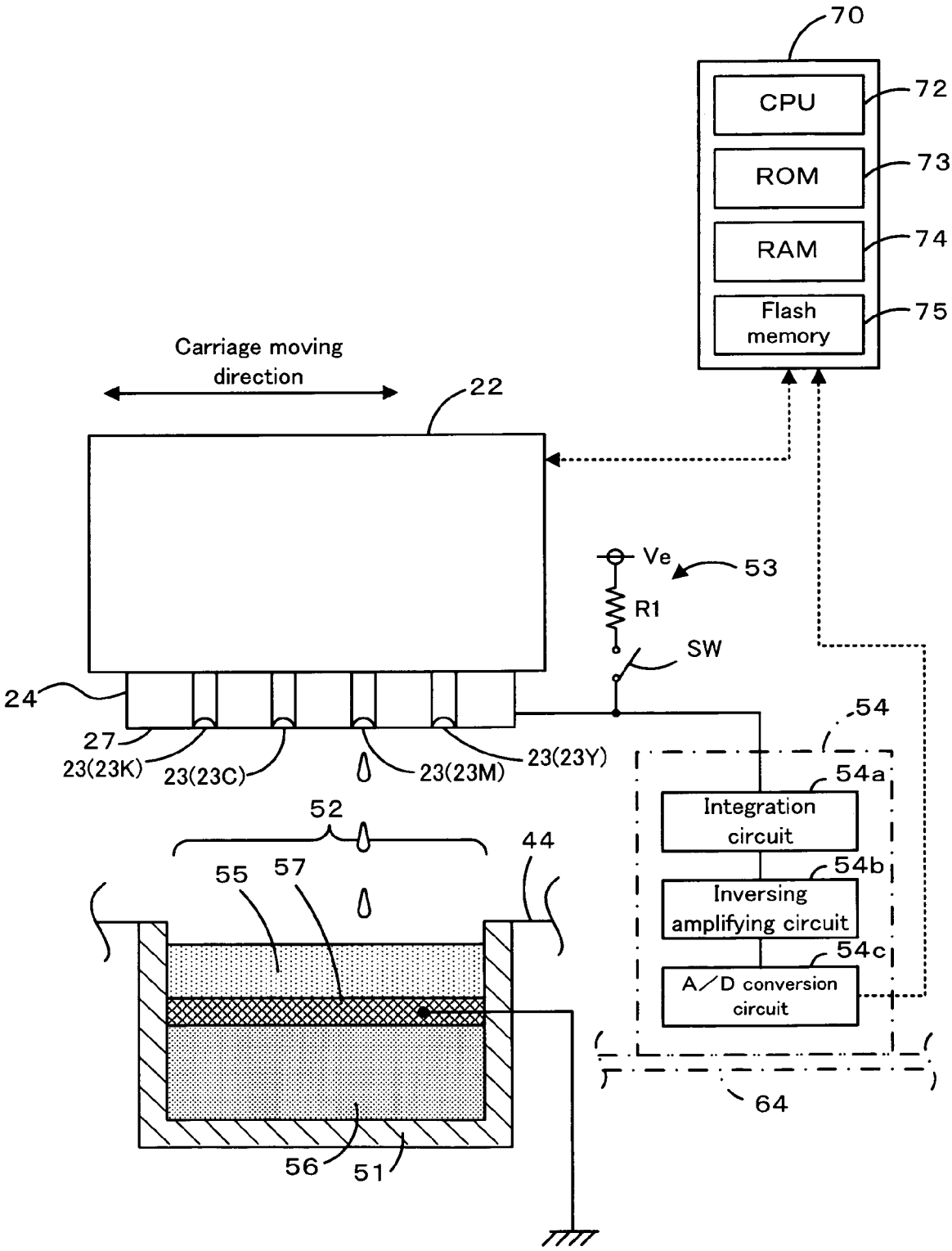
FIG. 6 is a block diagram schematically illustrating a configuration of a nozzle inspection device.

Next, one embodiment of the present invention will be described. FIG. 1 is a block diagram schematically illustrating a configuration of an ink jet printer 20 that is this embodiment. FIG. 2 is a perspective view when a carriage 22 is viewed from the lower side of a rear face. FIG. 3 is a left side elevation of the carriage 22 (this is a broken-out section view, and a partially enlarged illustration is shown inside the circle). FIG. 4 is an illustration of an electrical wiring connection of a print head 24. FIG. 5 is an illustration of a paper handling mechanism 31. FIG. 6 is a block diagram schematically illustrating a configuration of a nozzle inspection device 50.

As shown in FIG. 1, the ink jet printer 20 of this embodiment comprises a printer mechanism 21 that performs printing by ejecting ink droplets onto a recording sheet S that is carried over a platen 44 from the back to the front, a paper handling mechanism 31 that includes a line feed roller 35 driven by a driving motor 33, a capping device 40 formed in a neighborhood of the right edge of the platen 44, a nozzle inspection device 50 that is formed in the neighborhood of the left edge of the platen 44 and confirms whether or not ink droplets are being ejected by the print head 24 in a normal fashion, and a controller 70 for controlling the overall ink jet printer 20.

The printer mechanism 21 comprises a carriage 22 that is reciprocated along a guide 28 from side to side by means of a carriage belt 32; ink cartridges 26 incorporated in the carriage 22 and individually containing ink of various colors, of yellow (Y), magenta (M), cyan (C) and black (K); and a print head 24 for applying pressure to ink supplied from each of the ink cartridges 26.

The carriage 22 moves, as a carriage belt 32, erected between a carriage motor 34*a* installed to the right of a mechanical frame 80 and a driven roller 34*b* installed to the left of the mechanical frame 80, is driven by the carriage motor 34*a*. As shown in FIG. 2, an encoder board 64 that incorporates a photo detector 62 is mounted on the rear face of the carriage 22. The photo detector 62 exchanges signals with the controller 70 on the main board 84 (refer to FIG. 1) installed on the rear face of a mechanical frame 80, through flat cables 82 that are bundled wires on the encoder board 64 and inserted into a connector unit 66. The photo detector 62 also outputs to the controller 70 a position signal acquired by optically reading graduation of a linear scale 68 that is projected on the mechanical frame 80 so as to be parallel to the carriage belt 32. Then, on the basis of the position signal, the controller 70 determines where in the carriage moving direction (the main scanning direction) the carriage 22 is positioned. In addition, the photo detector 62 and the linear scale 68 constitute a linear encoder.

The ink cartridges (not shown) are constructed as container housing for print recording liquid to be used in printing, ink of cyan (C), magenta (M), yellow (Y) and black (K) that contains dye or pigments as a coloring agent and water as a solvent, and that is detachably mounted onto the carriage 22. As shown in FIG. 3, each of the ink cartridges 26 has an ink supply port 26*a* for each ink, and, when an ink supply needle 22*a* provided on the carriage 22 is inserted into the ink supply port 26*a*, the ink cartridges 26 can supply ink to the print head 24 formed on the underside of the carriage 22. In addition, on the flanks of the ink cartridges 26 is installed an integrated circuit board 26*b* for storing information such as the remaining amount of ink. The integrated circuit board 26*b* is electrically connected to the encoder board 64 byway of a connection terminal (not shown), and exchanges signals with the controller 70 on the main board 84 through the encoder board 64.

As shown in FIG. 3, the print head 24 comprises a nozzle plate 27 through which a plurality of nozzles 23 are perforated, a cavity plate 25 in which a nozzle chamber 29 is formed so as to communicate with the nozzles 23 formed on the nozzle plate 27, a piezoelectric element 48 pasted on a diaphragm 85 that defines the upper wall of the ink chamber 29, and a head driving board 30 on which a mask circuit 47 (see FIG. 4) for driving the piezoelectric element 48 is provided. In addition, ink is supplied to the ink chamber 29 from the ink supply ports 26*a* of the ink cartridges 26.

As shown in FIG. 4, on the nozzle plate 27 are provided nozzle arrays 43 in which the plurality of nozzles 23 are arranged to eject ink of the various colors of cyan (C), magenta (M), yellow (Y) and black (K). In this context, all the nozzles are collectively referred to as nozzles. 23; all the nozzle arrays 43 are collectively referred to as nozzle arrays 43; the cyan nozzle and the cyan nozzle array are respectively referred to as the nozzle 23C and the nozzle array 43C; the magenta nozzle and the magenta nozzle array are respectively referred to as the nozzle 23M and nozzle array 43M; the yellow nozzle and the yellow nozzle array are respectively referred to as the nozzle 23Y and the nozzle array 43Y; and the black nozzle and the black nozzle array are respectively referred to as the black nozzle 23K and nozzle array 43K. For purposes of the following description, a nozzle 23K is used. The print head 24 comprises a nozzle array 43K by arranging 180 nozzles 23K along a transport direction of the recording sheet S. A piezoelectric element 48 is provided within each nozzle 23k as a driving element for ejecting ink droplets, and ink is pressurized and ejected from the nozzles 23K by applying voltage to the piezoelectric element 48 and deforming the piezoelectric element 48. In the circle of FIG. 3 a pre-deformation piezoelectric element 48 is shown by a solid line, and a post-deformation piezoelectric element by a dotted line. As shown in this figure, after being deformed the piezoelectric element 48 pressurizes ink by holding down the diaphragm 85 of the ink chamber 29.

As shown in FIG. 1, the head driving board 30 is connected to the flat cable 82 by way of a connector unit (not shown), and exchanges signals with the controller 70 on the main board 84 through the flat cable 82. The mask circuit 47 formed on the head driving board 30 is provided so as to correspond with the piezoelectric element 48 that drives the respective nozzles 23K. An original signal ODRV or a print signal PRTn generated by the controller 70 is entered into the mask circuit 47. The letter n at the end of the print signal PRTn is a number that defines a nozzle included in a nozzle array. Since in this embodiment, a nozzle array consists of 180 nozzles, n is any integer value from 1 to 180. Within the spaces of one pixel (within the time in which the carriage 22 traverses an interval of one pixel) the original signal ODRV is composed of 4 drive waveforms of a microvibration pulse PV, a first pulse P1, a second pulse P2 and a third pulse P3. In this embodiment an original signal ODRV having four drive waveforms as a repetition unit is referred to as one segment. When the original signal ODRV, or the print signal PRTn, is entered, on the basis of these signals, the mask circuit 47 outputs any necessary pulse of a microvibration pulse Pv, a first pulse P1, a second pulse P2 and a third pulse P3 as the drive signal DRVn (n means the same as that of the print signal PRTn), to the piezoelectric element 48 of the nozzles 23K. More specifically, when the mask circuit 47 outputs only the microvibration pulse Pv to the piezoelectric element 48, ink simply vibrates inside the nozzles 23K and no ink droplet is ejected. A microvibration pulse Pv is usually given to a piezoelectric element 48 that corresponds to the nozzles 23K that are not expected to eject ink. When nozzles 23K that are not expected to eject ink are left as they are, ink in the nozzles 23K tends to clog easily, and thus to prevent this, ink in the nozzles 23K is vibrated. In addition, when the mask circuit 47 outputs only a first pulse P1 to the piezoelectric element 48, one shot of ink droplets is ejected from the nozzles 23K, and small sized dots (small dots) are formed on the recording sheet S. In addition, when the mask circuit 47 outputs a first pulse P1 and a second pulse P2 to the piezoelectric element 48, two shots of ink droplets are ejected from the nozzles 23*k* and medium sized dots (medium dots) are formed on the recording sheet S. In addition, when the mask circuit 47 outputs the first pulse P1, the second pulse P2, and the third pulse P3 to the piezoelectric element 48, three shots of ink droplets are ejected from the nozzles 23K and large sized dots (large dots) are formed on the recording sheet S. In such away, the ink jet printer 20 can form 3 sizes of dots by adjusting the amount of ink to be ejected during the interval of one pixel. Considerations similar to those of the nozzles 23K and nozzle array 43K described above, apply to the other nozzles 23C, 23M, and 23Y, or to the nozzle arrays 43C, 43M and 43Y. In addition, although in this context the print head 24 adopts the method of pressurizing ink by deforming the piezoelectric element 48, it may also adopt a method of pressurizing ink by means of air bubbles generated by applying voltage to a heat element (such as a heater) and heating ink.

As shown in FIG. 5, the paper handling mechanism 31 comprises a recording sheet insertion port 39 through which a recording sheet S placed on the paper feed tray 38 is inserted; a paper feed roller 36 for supplying to the print head 24 the recording sheet S placed on the paper feed tray 38; a line feed roller 35 for carrying the recording sheet S or roll of paper; and a paper ejection roller 37 for ejecting a printed recording sheet S. The paper feed roller 36, the line feed roller 35 and the paper ejecting roller 37 are driven by the drive motor 33 (see FIG. 1) through a gear mechanism (not shown). A rotating drive force and frictional resistance of a separating pad (not shown) prevent more than one recording sheet S from being fed at one and the same time. In FIG. 1, a transport direction of the recording sheet S is a direction from the back to the front, and the moving direction of the carriage 22 that moves with the print head 24 is the direction (main scanning direction) orthogonal to the transport direction of the recording sheet S.

As shown in FIG. 6, the nozzle inspection device 50 comprises an inspection box 51 on which ink droplets jetted from the nozzles 23 of the print head 24 can land; an inspection area 52 provided in the inspection box 51 and spaced a predetermined distance from the print head; a voltage application circuit 53 for generating a predetermined potential difference between the inspection area 52 and the print head 24; and a voltage detection circuit 54 for detecting voltage of the inspection area 52. Located at a location displaced to the left of a printable area of the platen 44, the inspection box 51 is an almost cuboid housing, with the top opened. The inspection area 52 is provided inside the inspection box 51, and comprised of a upper ink absorber 55 on which ink droplets can land directly; a lower ink absorber 56 that absorbs ink droplets that penetrate down after landing on the upper ink absorber 55, and a mesh-like electrode member 57 placed between the upper ink absorber 55 and the lower ink absorber 56. The upper ink absorber 55 is made of conductive sponge so as to have an identical potential to that of the electrode member 57, and its surface constitutes the inspection area 52. The sponge has such a high degree of penetration that ink droplets that have landed can move down promptly, and an ester-group urethane sponge (product name: Ever Light SK-E, manufactured by Bridgestone Corporation) is used herein. The lower ink absorber 56 retains more ink than the upper ink absorber 55, and is manufactured with a non-woven fabric such as felt. A non-woven fabric (product name: Kinocloth manufactured by OJI KINOCLOTH CO., LTD.) is used herein. The electrode member 57 is formed as a grid-like mesh made of stainless metal (e.g., SUS). Thus, ink that has once been absorbed by the upper ink absorber 55 passes through gaps in the mesh-like electrode member 57, and is absorbed and retained by the lower ink absorber 56. The electrode member 57 is grounded to the ground through the mechanical frame 80 (see FIG. 1). In this context, as the electrode member 57 contacts the upper ink absorber 55, in the same way as the electrode member 57, the surface of the upper ink absorber 55, namely, the inspection area 52, also has a grounding potential. The voltage application circuit 53 intensifies voltage of electric wiring that is laid inside the ink jet printer 20 from a few volts to several tens, and several hundreds of volts, by way of a booster circuit (not shown), and applies to the nozzle plate 27 of the print head 24 through a resistance R1 and a switch SW a post-surging of pressure voltage Ve. As shown in FIG. 2 and FIG. 3, the voltage detection circuit 54 is positioned next to the photo detector 62 on the encoder board 64 mounted on the carriage 22. The voltage detection circuit 54 comprises an integration circuit 54*a* that is connected so as to detect voltage of the nozzle plate 27, and that integrates and outputs a voltage signal of the nozzle plate 27; an inverting and amplifying circuit 54*b* that inverts and amplifies signals outputted from the integration circuit 54*a*; and an A/D conversion circuit 54*c* that A/D converts signals outputted from the inverting amplifying circuit 54*b* and outputs to the controller 70. Since a change in voltage resulting from the flight or landing of one ink droplet is weak, by means of integrating voltage change from more than one ink droplet, the integration circuit 54*a* outputs the signal as a significant voltage change. The inversing amplifying circuit 54 not only inverts positive and negative in voltage change, but also amplifies signals outputted from the integration circuit by a predetermined amplification factor that is dictated by the circuit configuration, and outputs the results. The A/D conversion circuit 54*c* converts an analog signal outputted from the inversing amplifying circuit 54*b* into a digital signal and outputs it to the controller 70.

As shown in FIG. 1, a capping device 40 is used to block the nozzles 23 so as to prevent the nozzles 23 from being dried at the times when printing has been stopped. The capping device 40 is actuated to cover the nozzle-formed surface of the print head 24 when the print head 24 travels, together with the carriage 22, to the right edge (referred to as a home position). A suction pump (not shown) is also connected to the capping device 40, and when, for instance, the nozzle inspection device 50 detects ink clogging within a nozzle, negative pressure of the suction pump is applied on the nozzle plate 27 of the print head 20 that has been blocked by the capping device 40 so as to suction and eject clogged ink from the nozzle 23. Waste ink that has been suctioned and ejected is accumulated in a waste liquid tank (not shown).

As shown in FIG. 1, provided on the main board 84 installed on the rear face of the mechanical frame 80, the controller 70 is configured as a microprocessor centered on a CPU 72, and comprises a ROM 73 storing various types of processing programs; a RAM 74 for temporarily storing or saving data; a flash memory 75 into, or from, which data can be written, or erased; an interface (I/F) 79 for exchanging information with external equipment; and an input/output port (not shown). The respective processing programs such as the main routine or the nozzle inspection routine, and the print processing routine, all to be described later, are stored in the ROM 73. In addition, a print buffer area is provided in the RAM 74, and print data sent from the user PC 110 through I/F 79 is stored therein. Not only is a voltage signal outputted from the voltage detection circuit 54 of the nozzle inspection device 50, or a position signal of the carriage 22 from the photo detector 62, inputted into the controller 70 through the input port (not shown), but also print data outputted from a user PC 110, etc. is inputted thereto through the I/F 79. In addition, not only a control signal to the print head 24 (including the mask circuit 47 or the piezoelectric element 48) or to the drive motor 33, but also signals such as a drive signal to the carriage motor 34*a* or a motion control signal to the capping device 40 are outputted from the controller 70 through an output port (not shown), and print status information intended for the user PC 110, etc. is also outputted therefrom through the I/F 79.

Figure 7:
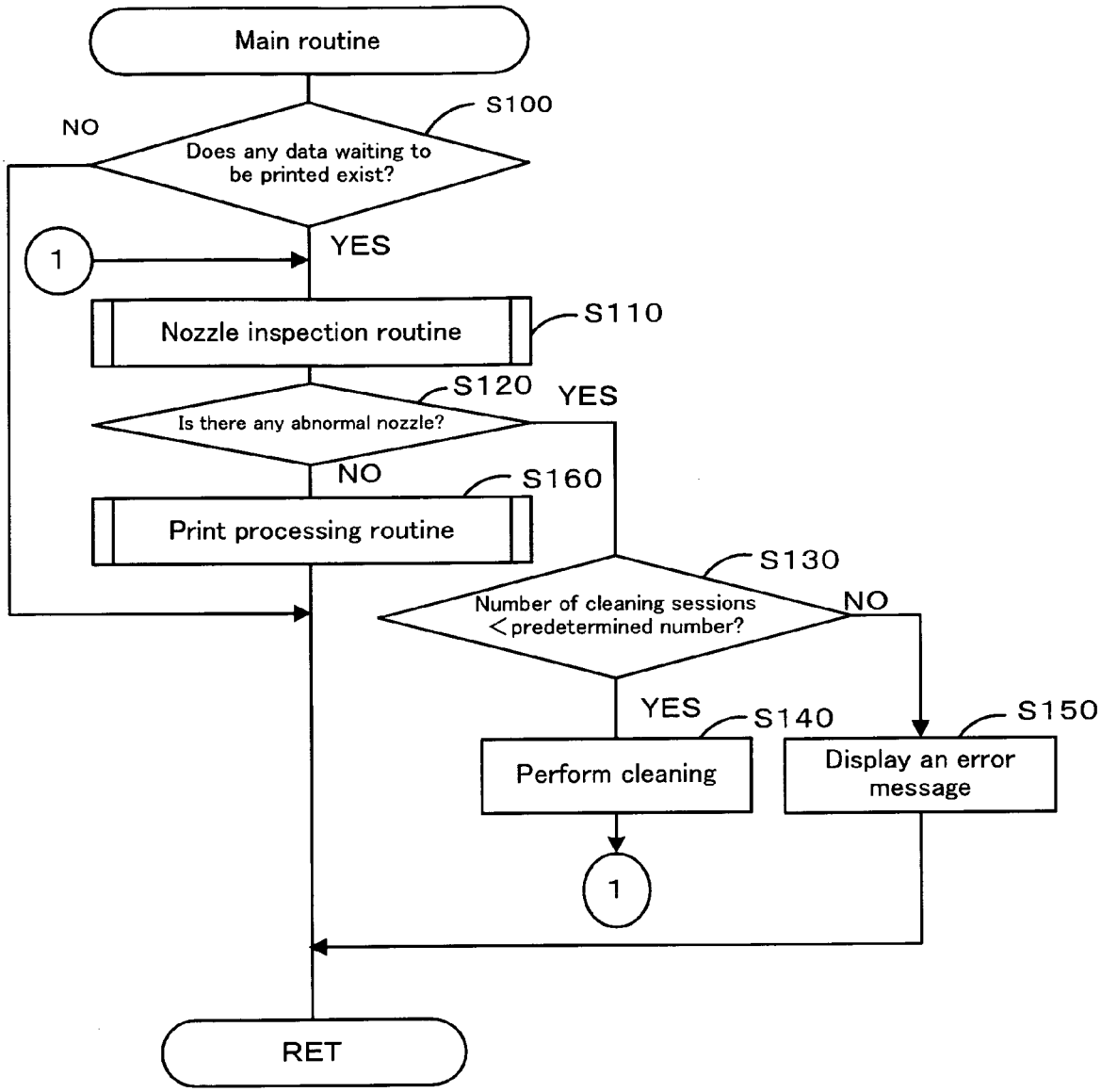
FIG. 7 is a flow chart of a main routine.

An operation of the ink jet printer 20 of this embodiment thus configured will next be described. The operation of the main routine will first be described on the basis of FIG. 7. FIG. 7 is a flow chart of the main routine to be executed by the CPU 72 of the controller 70. The routine is executed by the CPU 72 at predetermined times (for instance, every few msecs) after the power of the ink jet printer 20 has been turned on. When the routine starts, the CPU 72 judges first whether or not any print job exists within a print queue (step S100). A print job received from the user PC 110 is put into the print buffer area formed in the RAM 74 and becomes a print job waiting to be printed. Thus, although a print job could be immediately printed in the same way as it were being printed after it has been received, in the first instance, it goes into a state waiting to be printed. Then, when in step S100 there is no print job in a state waiting to be printed, the main routine just comes to an end.

Figure 8:
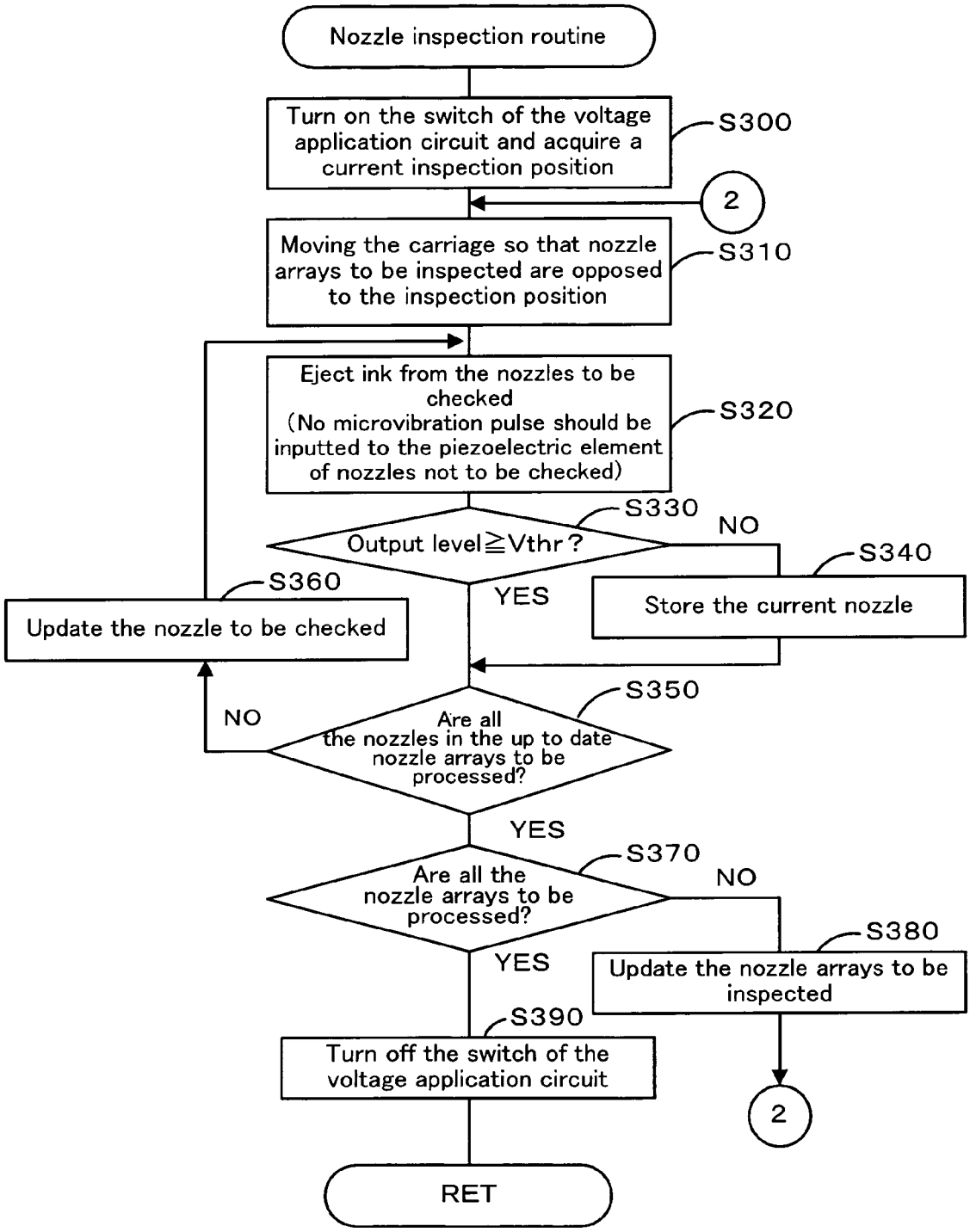
FIG. 8 is a flow chart of a nozzle inspection routine.
Figure 9:
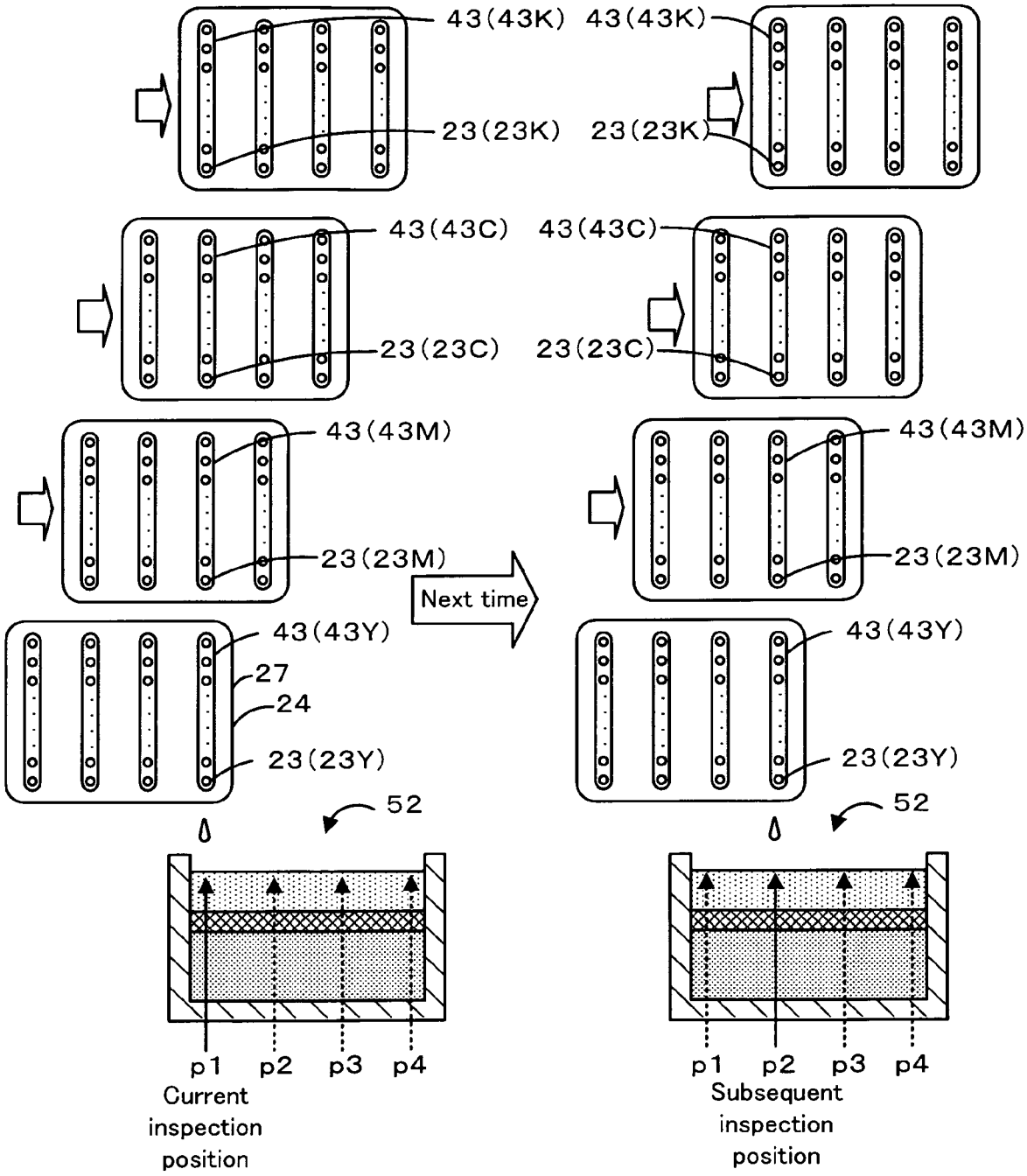
FIG. 9 is an illustration of an inspection position during a nozzle inspection process.

On the other hand, when in step S100 any print job exists in a state waiting to be printed, the nozzle inspection routine is executed (step S110). FIG. 8 is a flow chart of the nozzle inspection routine. When the nozzle inspection routine starts, the CPU 72 not only first turns on the switch SW of the voltage application circuit 53 and generates a predetermined potential difference between the inspection area 52 and the print head 24, but also acquires a location in the inspection area 52 where ink is ejected from the nozzles 23 (step S300). In this context, since, because of the ejecting of ink, any solid matter contained in the ink may be deposited on the surface of the inspection area 52, the CPU 72 is set to change an inspection position every time that a nozzle inspection routine is executed. FIG. 9 is an illustration of an inspection position in the nozzle inspection process. In FIG. 9, with a plurality of inspection positions p1, p2, p3, and p4, a setting is made such that ink is ejected to an identical inspection position within each nozzle array 43 so that no variations can be generated in detected values of induced voltage as a result of different inspection positions. For instance, when this nozzle inspection is performed at the inspection position p1, the nozzle array 43Y is first positioned so as to be opposed to the inspection position p1, and ink droplets are sequentially ejected from respective nozzles 23Y included in the nozzle array 43Y. Then, the nozzle array 43M is positioned so as to be opposed to the inspection position p1, and ink droplets are sequentially ejected from the respective nozzles 23M included in the nozzle array 43M. After that, in a similar fashion in the cases of nozzle arrays 43C, 43K, at the check position p1, ink droplets are sequentially ejected from the respective nozzles 23C, 23K. Furthermore, to avoid too much ink solid matter being deposited at specific inspection positions, a setting is made such that ink is ejected to a subsequent inspection position that is different from the current inspection position. For instance, when the current nozzle inspection is executed at the inspection position p1, a next nozzle check takes place in a check position 2. Referring back to FIG. 8, after a current inspection position has been acquired in step S300, the CPU 72 drives the carriage motor 34*a* so as to move the carriage 22 in such a way among the nozzle arrays 43 of the print head 24 that those nozzle arrays 43 that are to be subjected to inspection are opposed to the current inspection position (Step S310). Then, the CPU 72 not only prevents the mask circuit 47 from inputting to the piezoelectric element 48 associated with nozzles 23 that do not eject ink, the microvibration pulse Pv, as well as the first to third pulses P1 to P3, but also causes the mask circuit 47 to input to the piezoelectric element 48 associated with the one nozzle 23 among the nozzle arrays 43 that is subject to inspection, the first to third pulses P1 to P3 thereby causing the nozzle 23 to eject charged ink droplets (step S320).

In normal printing, a mask circuit 47 associated with nozzles 23 that do not eject ink inputs only the microvibration pulse Pv to the piezoelectric element 48, causes ink in the nozzles 23 to vibrate, and thereby prevents ink from drying and hardening in the vicinity of the ejection port of the nozzles 23. However, when a similar process is performed during a nozzle inspection, detected voltage may be concealed by noise because the voltage detection circuit 54 has adopted a configuration designated to detect voltage of the nozzle plate 27. In other words, whereas voltage detected is weak as there is only one nozzle 23 to eject ink during an ink inspection, the effects of noise caused by the microvibration pulse Pv are profound as all the remaining nozzles 23 do not eject ink. Thus, the piezoelectric element 48 associated with the nozzles 23 that do not eject ink is prevented from inputting any pulse including the microvibration pulse Pv.

In addition, when an experiment involving ejecting ink droplets from the nozzles 23 with the inspection area 52 grounded to the ground and voltage applied to the nozzle plate 27 has actually been performed, an output signal waveform of the nozzle plate 27 has manifested itself as a sine curve. Although the principle whereby such an output signal waveform is obtained is unknown, it is believed that this can be attributed to induced current flowing as a result of electrostatic induction as charged ink droplets approach to the inspection area. In addition, amplitude of output signal waveform from the nozzle plate 27 depended on not only a distance from the print head 24 to the upper ink absorber 55 (inspection area 52) but also on the presence, or absence, of flying ink droplets, and on the sizes thereof. Therefore, as an amplitude of an output signal waveform is less than that in a normal operation, or almost zero, for instance, when ink droplets are not jetted as a result of clogged nozzles 23, or less than a predetermined range, on the basis of the amplitude of the output signal waveform, it is possible to judge whether or not clogging of the nozzles 23 has occurred. In this embodiment, since an amplitude of output signal waveforms based on one shot of ink droplets was weak even though they were of a predetermined size, 24 shots of ink droplets were ejected by outputting all of the first to third pulses P1, P2, and P3 existing in one segment representative of the drive waveform a total of eight times. In consequence, the output signal was an integrated value based on the 24 shots of ink droplets, and thus a sufficiently large output signal waveform could be obtained from the voltage detection circuit 54.

Referring back to FIG. 8, after causing one nozzle 23 of the nozzle arrays 43 subjected to inspection to eject charged ink droplets, the CPU 72 judges whether or not the amplitude of the signal waveform detected by the voltage detection circuit 54, namely, the output level, exceeds a threshold Vthr (step S330). The threshold Vthr has been empirically defined so that it is exceeded by the output level (peak value) of output signal waveform when 24 shots of ink droplets are normally ejected, but it is also defined so that when the 24 shots of ink droplets are not ejected normally it is not to be exceeded due to factors such as noise. Then, when the output level at step S330 is less than the threshold Vthr, the CPU 72 deems that an abnormality such as clogging has occurred at the current nozzle 23, and stores in a predetermined area of the RAM 74 information specifying the nozzle 23 in question(for instance, information showing what number of nozzle in which nozzle array it is). After this step S340, or when in step S330 the output level exceeds the threshold Vthr (in other words, when the current nozzle 23 is normal), the CPU 72 judges whether or not all the nozzles 23 included in the nozzle array 43 that is now being inspected have been inspected (step S350). When there is any uninspected nozzle 23 existing in the nozzle array 43 now under inspection, the CPU 72 updates a nozzle 23 that is to be subjected to inspection to the uninspected nozzle 23 (step S360), and then repeats the processes after step S320. On the other hand, when in step S350, all the nozzles 23 included in the nozzle array 43 now being checked have been inspected, the CPU 72 judges whether or not all the nozzle arrays 43 included in the print head 24 have been inspected (step S370). When any nozzle array 43 remains uninspected, the CPU 72 updates the nozzle array 43 that is to be subjected to inspection to the uninspected nozzle array 43 (step S380), and then repeats the processes after step S310. On the other hand, when, in step S370, all the nozzle arrays 43 included in the print head have been inspected, the CPU 72 turns off the switch SW of the voltage application circuit 53 (step S390), and terminates the nozzle inspection routine. When any abnormal nozzle 23 exists among all the nozzles arranged in the print head 24, information defining that nozzle 23 is stored in a predetermined area in the RAM 74. When no abnormal nozzle 23 exists, nothing is stored therein.

Referring back now to the main routine in FIG. 7, after executing the nozzle check routine as described above (step S110), the CPU 72 judges on the basis of the contents of storage in the predetermined area in the RAM 74 whether or not any abnormal nozzle 23 exists among all the nozzles 23 arranged in the print head 24 (step S120). When any abnormal nozzle 23 exists, a conclusion is reached that clogging is the cause, and cleaning of the print head 24 takes place. However, before this is done, the CPU 72 judges whether or not the number of cleaning sessions has reached a predetermined upper limit (for instance, three times) (step S130). When the number of cleaning sessions is less than the upper limit, cleaning of the print head 24 takes place (step S140). More specifically, the CPU 72 drives the carriage motor 34*a* to move the carriage 22 until the print head 24 reaches the home position that is opposed to the capping device 40, and then actuates the capping device 40 so that the capping device 40 covers the nozzle-formed surface of the print head 24. Then, acting negative pressure of the suction pump (not shown) is applied on the nozzle-formed surface, and this causes clogged ink to be suctioned and ejected. After cleaning has been performed, the CPU 72 returns to step S110 to check whether or not the abnormality in the nozzle 23 has been rectified. In this step S110, although only a nozzle 23 where an abnormality has occurred may be re-checked, all the nozzles of the print head 24 are re-checked as nozzles 23 that were normal during cleaning but that might for some reason have been clogged. On the other hand, when, in step S130, the number of cleaning sessions has already reached the upper limit, the CPU 72 deems that the abnormal nozzle 23 has not returned to a normal state although cleaning has been performed, the CPU 72 displays an error message on an operation panel (not shown) (step S150), and terminates the main routine. On the other hand, when, in step S120, no abnormal nozzle exits, the CPU 72 executes the print processing routine (step S160) and then terminates the main routine.

Figure 10:
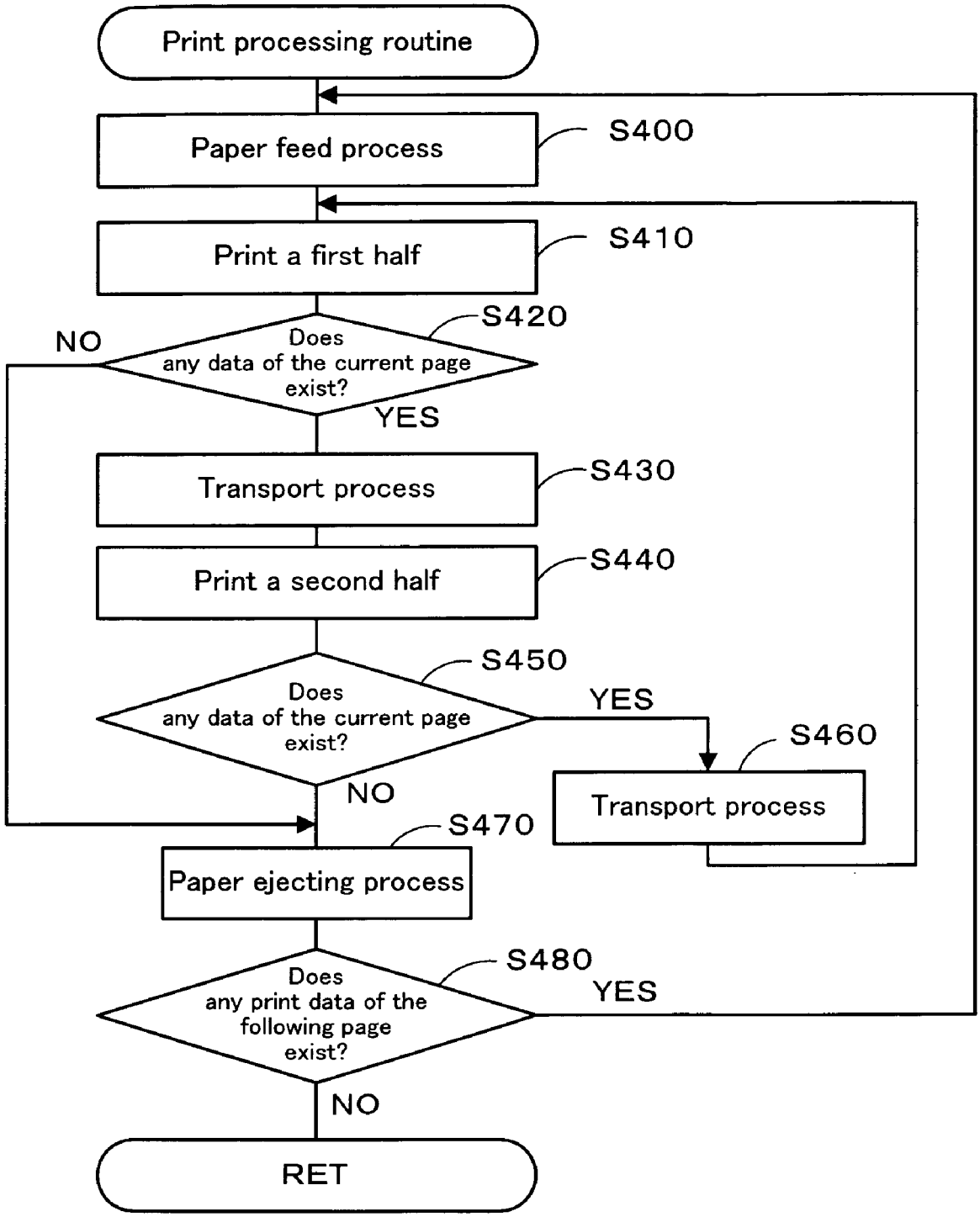
FIG. 10 is a flow chart of a printing process routine.

FIG. 10 is a flow chart of the print processing routine. When the print processing routine starts, the CPU 72 first performs a paper feed process (step S400). The paper feed process drives the drive motor 33, rotates and drives the paper feed roller 36 (see FIG. 5), and carries a recording sheet S placed on the paper feed tray 38 to the line feed roller 35. Then, the CPU 72 performs the first half of printing on the basis of the print data, while moving the carriage 22 from the home position, etc., to the left, as illustrated in FIG. 1, by driving the carriage motor 34*a*, and by then causing the print head 24 to eject ink (step S410). Then, the CPU 72 judges whether or not any print data that is being printed needs to be printed on the recording sheet S (step S420). When any print data that is being printed needs to be printed on the recording sheet S, the CPU 72 performs a transport process of rotating and driving the line feed roller 35 and carrying the recording sheet S for a predetermined number (step S430), and then performs the second half of printing on the basis of the print data while moving the carriage 22 to the right, as illustrated in FIG. 1, by driving the carriage motor 34*a*, and by then causing the print head to eject ink (step S440). Then, the CPU 72 judges whether or not any print data that is being printed needs to be printed on the recording sheet (step S450). When any print data being printed does need to be printed on the recording sheet S, the CPU 72 performs the transport process of rotating and driving the line feed roller 35 and carrying the recording sheet S for a predetermined number (step S460) and then performs the processes after step S410. On the other hand, when, in step S420 or step S450, no print data being printed needs to be printed on the recording sheet S, the CPU 72 performs a paper ejection process for ejecting the recording sheet S (step S470). The paper ejection process rotates and drives the paper ejection roller 37 and ejects the recording sheet S onto the catch tray. Then after step S470, the CPU 72 judges whether or not any print data of a following page exists (step S480). When any print data of a following page does exist, the CPU 72 returns to step S400 once again. When no print data of a following page does exist, the CPU 72 terminates the print processing routine.

At this point the relationship between components of this embodiment and those of this invention will be clarified. The mask circuit 47 and the piezoelectric element 48 of the embodiment correspond to the drive module of the invention; the inspection area 52 corresponds to the print recording liquid receiving area; the voltage application circuit 53 corresponds to the potential difference generation module; the voltage detection circuit 54 corresponds to the electrical change detection module, and the CPU 72 of the controller 70 corresponds to the inspection execution module. In the embodiment, one example of the nozzle inspection method of this invention will be clarified by describing an operation of the ink jet printer 20.

According to the ink jet printer 20 that has so far elaborately described, because ink does not easily accumulate on the print head 24, while on the other hand ink does easily accumulate on the nozzle inspection device 50, electrical change in ink in the print head 24 is detected through the nozzle plate 27 provided on the print head 24, and thus leaks of a detection signal caused by ink deposits are less likely to occur. Thus, during a nozzle inspection it is possible to obtain the detection characteristics desired.

Furthermore, as the voltage detection circuit 54 is provided on the encoder board 64 on the carriage 22, and a distance between the nozzle plate 27 and the voltage detection circuit 54 is shorter, a detection signal is less likely to be affected by noise. Furthermore, as the voltage detection circuit 54 is provided on the existing board, i.e., the encoder board 64, there is no need to prepare a new board for the voltage detection circuit 54.

A further point is that, as it is prohibited to subject ink to microvibration in the nozzles 23 during a nozzle inspection, noise attributable to the microvibration pulse Pv does not affect a detection signal of the nozzle plate 27, and thus does not lead to a diminution in the accuracy of inspection.

Furthermore, since the voltage detection circuit 54 includes the integration circuit 54*a*, the inverting amplifying circuit 54*b*, and the A/D conversion circuit 54*c*, in comparison with the possible effects of noise produced when a pre-amplification signal is transmitted to the same location, the possible effects of noise can be reduced even if noise were produced when a detection signal is transmitted to the controller 70 at a relatively remote location from the voltage detection circuit 54.

Moreover, as the inspection area 52 is grounded to the ground and voltage is applied to the nozzle plate 27 during a nozzle inspection, there is no risk of leaks of current. As a result, predetermined potential difference is not generated between the nozzle plate 27 and the inspection area 52. On the other hand, when the nozzle plate 27 is grounded to the ground and voltage is applied to the inspection area 52 during a nozzle inspection, there is a risk of leaks of current caused by ink deposits accumulating in the inspection area 52, and of a predetermined potential difference not being generated between the nozzle plate 27 and the inspection area 52.

In addition, as low voltage of electrical wiring laid in any place other than the carriage 22 of the ink jet printer 20 is increased by a booster circuit provided on the carriage 22, and then voltage is applied to the nozzle plate 27, voltage of electrical wiring in places other than the carriage 22 can be maintained at a low level.

It goes without saying that the present invention is by no means limited to the embodiments described above, but can be implemented in various embodiments as long as they remain within the technical scope of the invention.

In the embodiments described above, the nozzle plate 27 is utilized to detect electrical change in ink in the print head 24, or to apply voltage to ink in the print head 24. However, any conductive member other than the nozzle plate 27 may be employed as long as it contacts ink in the print head 24. For instance, when a cavity plate 25 is formed of a conducting material the cavity plate 25 may be utilized. When a nozzle plate 72 or the cavity plate 25 is formed of an insulating material, an electrode member (conducting material) formed to contact ink in the print head 24 may be used. In addition, when the print head 24 has a cavity plate 25 formed of an insulating material and a nozzle plate 27 that is formed of a conducting material and its surface is coated by an insulating film (a water-repellent film), an electrode member (conducting material) may be provided at a position on the cavity plate 25 that contacts ink. The voltage application circuit 53 is utilized to apply voltage to ink and a detection terminal of the voltage detection circuit 54 may be connected to a part of the nozzle plate 27 formed of conducting material.

In the embodiments described above, as shown in FIG. 1, the nozzle inspection device 50 is provided to the left of the platen 44. However, an inspection box 51 including an inspection area 52 may be provided either on the capping device 40 or in an area provided on the platen 44 that is made longer than a sheet width for edgeless printing, etc. In addition, although it is omitted in FIG. 1, any area that is provided for the purpose of ejecting ink from the nozzles 23 onto any area other than a sheet of paper so as to clear nozzle clogging (may be referred to as a flushing action) may be made the inspection area 52. In such cases, and in a similar fashion to the embodiments described above, an electrode member may be provided in the inspection area 52. In addition, as the print head 24 and the inspection area 52 may be positioned close to one another, when the capping device 50 and the inspection device 52 are combined, this is preferable in terms of accuracy of inspection, and can also be made with the print head 24 still at the home position.

In the embodiments described above, although the configuration should be such that the voltage detection circuit 54 is provided on the board or on the carriage 22 on the print head 24, the voltage detection circuit 54 may be provided at any location inside the ink jet printer. In such a case, a signal line pulled out from the nozzle plate 27 of the print head 24 may accompany the flat cable 82 and be connected with the voltage detection circuit irrespective of whatever location is selected for the voltage detection circuit inside the ink jet printer 20.

Although in the embodiments described above, the voltage detection circuit 54 for detecting voltage of the nozzle plate 27 is formed on the encoder board 64 on the carriage 22, the voltage detection circuit 54 may be formed on the head driving board 30 (see FIG. 3) on the print head 24, or on the integrated circuit board 26*b* on the ink cartridges 26. Also in these cases, similar effects to those of the embodiments described above can be achieved. Thus, when the voltage detection circuit 54 is installed on the print head 24, as in the cases of the embodiments described above, it may be possible to adopt a method according to which printing is performed while the print head is moved in a main scanning direction, or to adopt a so-called line printer that has a long print head formed so as to fill a printing area in a width direction of a print medium, that is fixed to the main body of the apparatus, and that performs printing while transporting only the print medium (refer to Japanese Patent Application Laid Open No. 2002-200779). In addition, when the former of these two method of performing printing while moving the print head 24 in the main scanning direction is adopted, as the ink cartridges 26, as well as the print head 24, are installed on the carriage 22, the boards 26*b* and 30 are boards on the print head 24 as well as being at the same time boards on the carriage 22.

In the embodiments described above, although during a nozzle inspection the inspection area 52 is grounded to the ground and voltage is applied to the nozzle plate 27, the nozzle plate 27 may be grounded to the ground and voltage may be applied to the inspection area 52. However, as there is a risk that current may leak in the inspection area 52 due to ink deposits, etc., it is preferable to apply voltage to the nozzle plate 27.

Although in the embodiments described above, it is not specifically provided where a booster circuit should be placed so as to obtain voltage Ve of the circuit application circuit 53, a booster circuit may be provided on the same board as the voltage detection circuit 54. This would eliminate the need for preparing separately a board on which the booster circuit needs to be installed.

Although in the embodiments described above, the upper ink absorber 55 and the lower ink absorber 56 are provided in the inspection box 51, either one of them or both of them, may be omitted. For instance, the configuration may be such that only the electrode member 57 is placed in the inspection box 51 and that ink is directly ejected onto the electrode member 57. Alternatively, as a predetermined potential difference is generated between ink in the nozzle plate 27 and the electrode member 57, the upper ink absorber 55 does not necessarily need to have conducting properties, and the upper ink absorber 55 may be formed, for instance, of an insulating material.

This application bases its claim for priority on the Japanese Patent Applications No. 2005-288639 filed on Sep. 30, 2005 and No. 2006-31367 filed on Feb. 8, 2006, and which are hereby incorporated by reference in their entirety.

What is claimed is:

1. A nozzle inspection method of an ink jet recording apparatus that performs printing on a print medium by using a print head having a plurality of nozzles, comprising:

a nozzle inspection step of sequentially generating pressure on a print recording liquid in individual nozzles with a predetermined potential difference generated between a print recording liquid receiving area that can receive print receiving liquid ejected from each nozzle and print recording liquid in the print head to eject the print recording liquid as ink droplets where the ink droplets ejected from each nozzle land on the print recording liquid receiving area after being detached from each nozzle, and on the basis of electrical change, which occurs with ejection of the ink droplets, at the print head carrying out a nozzle inspection so as to confirm whether or not the print recording liquid can be ejected from each nozzle;

wherein said nozzle inspection step comprises an electrical change detecting step detecting electrical change in the print recording liquid in the print head using a detection device provided on a board on the print head, or on a board on a carriage for moving the print head.

2. The nozzle inspection method of claim 1, wherein the nozzle inspection step, pressure is sequentially generated on the print recording liquid in each nozzle with the predetermined potential difference generated between the print recording liquid in the print head and the print recording liquid receiving area, and on the basis of electrical change in the print recording liquid in the print head a nozzle inspection is performed so as to confirm whether or not print recording liquid can be ejected from each nozzle.

3. The nozzle inspection method of claim 2, wherein during the nozzle inspection step, at a time of detecting electrical change in the print recording liquid in the print head, electric change is detected in a nozzle plate on the print head.

4. The nozzle inspection method of claim 2, wherein during the nozzle inspection step, at a time of detecting electrical change in the print recording liquid in the print head, electrical change at the print head occurring in response to landing of the print recording liquid from each nozzle on the print recording liquid receiving area within the nozzles is detected.

5. The nozzle inspection method of claim 2, further comprising a vibration generation step of generating minute pressure on the print recording liquid in the nozzles until the print recording liquid is vibrated but not ejected, for nozzles that are not expected to eject print recording liquid during printing and recording, wherein the nozzle inspection step the vibration generation step is prevented from being executed.

6. The nozzle inspection method of claim 2, wherein the detection device for detecting electrical change in the print recording liquid in the print head includes at least a circuit for amplifying the electrical change in the print recording liquid of the print head.

7. The nozzle inspection method of claim 2, wherein the print head has a nozzle-forming member for forming a plurality of nozzles, and a detection device for detecting electrical change in the print recording liquid in the print head detects electrical change in the nozzle-forming member.

8. The nozzle inspection method of claim 1, wherein during the nozzle detection step, at the time of generating the predetermined potential difference between the print recording liquid in the print head and the print recording liquid receiving area, the print recording liquid receiving area is grounded to the ground and voltage is applied to the print recording liquid in the print head.

9. The nozzle inspection method of claim 8, wherein a device for generating the predetermined potential difference is a circuit that increases voltage of electrical wiring of a low voltage level, and that has been laid in the recording apparatus, and wherein the circuit is provided in the print head or the carriage and applies voltage to the print recording liquid in the print head.

10. The nozzle inspection method of claim 9, wherein the device for generating the predetermined potential difference is provided on a board on the print head, or on a board on the carriage that moves the print head, together with a detection device for detecting electrical change in the print recording liquid in the print head.

11. An ink jet recording apparatus for performing printing on a print medium by using a print head having a plurality of nozzles, the ink jet recording apparatus comprising:

a driving module that drives the print head so that pressure is generated on a print recording liquid in the print head;

a print recording liquid receiving area that is placed to receive the print recording liquid ejected from each nozzle;

a potential difference generation module that generates a predetermined potential difference between the print recording liquid in the print head and the print recording liquid receiving area;

an electrical change detection module that detects electrical change at the print head;

an inspection execution module that controls the driving module so that, in a condition in which the potential difference generation module has generated the predetermined potential difference between the print recording liquid in the print head and the print recording liquid receiving area, pressure is sequentially generated on the print recording liquid in individual nozzles, the print head ejects the print recording liquid as ink droplets where the ink droplets ejected from each nozzle land on the print recording liquid receiving area after being detached from each nozzle, and so that, on the basis of electrical change, which occurs with ejection of the ink droplets, at the print head a nozzle inspection is performed so as to confirm whether or not the print recording liquid can be ejected from each nozzle;

wherein said inspection execution module comprises an electrical change detecting module provided on a board on the print head, or on a board on a carriage for moving the print head, which detects electrical change in the print recording liquid in the print head.

* * * * *